US011181300B2

(12) United States Patent
Saubert et al.

(10) Patent No.: US 11,181,300 B2
(45) Date of Patent: Nov. 23, 2021

(54) PERSONAL HEATER

(71) Applicant: TRANSFORM SR BRANDS LLC, Hoffman Estates, IL (US)

(72) Inventors: Michael Saubert, Hoffman Estates, IL (US); Elvin Bautista, Hoffman Estates, IL (US); Salameh Alsweis, Hoffman Estates, IL (US); Thaddeus J. Lepucki, Hoffman Estates, IL (US); Lindsey Brinkworth, Hoffman Estates, IL (US)

(73) Assignee: Transform SR Brands LLC, Hoffman Estates, IL (US)

( * ) Notice: Subject to any disclaimer, the term of this patent is extended or adjusted under 35 U.S.C. 154(b) by 280 days.

(21) Appl. No.: 16/209,607

(22) Filed: Dec. 4, 2018

(65) Prior Publication Data

US 2019/0170397 A1 Jun. 6, 2019

Related U.S. Application Data

(60) Provisional application No. 62/594,472, filed on Dec. 4, 2017.

(51) Int. Cl.

| | |
|---|---|
| ***F24H 3/04*** | (2006.01) |
| ***F24H 9/20*** | (2006.01) |
| ***H05B 1/02*** | (2006.01) |
| ***F24F 1/00*** | (2019.01) |

(52) U.S. Cl.

CPC ..... *F24H 3/0417* (2013.01); *F24F 1/00* (2013.01); *F24H 9/2071* (2013.01); *H05B 1/0252* (2013.01)

(58) Field of Classification Search

None

See application file for complete search history.

(56) References Cited

U.S. PATENT DOCUMENTS

| | | | | | |
|---|---|---|---|---|---|
| 1,460,915 | A | * | 7/1923 | Luton | 126/204 |
| 1,544,730 | A | * | 7/1925 | Dressler | F24H 3/0417 392/367 |
| 2,126,918 | A | * | 8/1938 | Phillips | F24H 3/0417 392/358 |
| 2,184,858 | A | * | 12/1939 | Goodman | A45D 29/18 34/87 |
| 2,267,158 | A | * | 12/1941 | Locke | A47L 23/205 34/90 |
| 2,420,251 | A | * | 5/1947 | La Foriyes | A45D 20/22 34/100 |
| 2,706,237 | A | * | 4/1955 | Hare | A61F 7/02 219/390 |
| 2,721,254 | A | * | 10/1955 | Burgess | F24H 3/0417 392/369 |
| 2,851,573 | A | * | 9/1958 | Muccilli | A61F 7/02 219/217 |

(Continued)

*Primary Examiner* — Thor S Campbell

(74) *Attorney, Agent, or Firm* — McAndrews, Held & Malloy, Ltd.

(57) ABSTRACT

Systems and methods for providing a personal heater are disclosed. In some embodiments, the personal heater comprises a housing, a heating element, and a controller. The housing is configured with an opening for receiving one or more feet. The controller is configured to cause the heating element to heat one or both of an interior and an exterior of the housing based on whether the one or more feet are inside the housing.

16 Claims, 7 Drawing Sheets

(56) References Cited

U.S. PATENT DOCUMENTS 3,283,756 A * 11/1966 Turley ..... A61H 35/006 601/166
3,366,105 A * 1/1968 Sadowski ..... A61H 23/02 601/16
3,683,896 A * 8/1972 Peplin ..... A61H 23/02 601/16
3,837,334 A * 9/1974 Johnson ..... A61H 35/006 601/19
3,930,320 A * 1/1976 Henderson ..... A45D 29/18 34/202
4,057,053 A * 11/1977 Kunz ..... A47K 3/10 601/27
4,159,714 A * 7/1979 Peterson ..... A47C 3/02 297/461
4,192,297 A * 3/1980 Labrecque ..... A61H 9/00 601/166
4,492,221 A * 1/1985 Kerley ..... A61H 9/00 601/16
4,495,935 A * 1/1985 Lanier ..... A47C 7/748 126/204
4,497,313 A * 2/1985 Kurosawa ..... A61H 35/006 601/156
5,007,182 A * 4/1991 Fishman ..... A47K 10/48 34/202
5,157,850 A * 10/1992 Terng-Shuh ..... F26B 9/003 34/202
5,280,679 A * 1/1994 Edelman ..... A47K 10/48 34/202
5,501,682 A * 3/1996 Edwards-Cofie ..... A45D 29/22 132/73.5
5,613,304 A * 3/1997 Lin ..... A47K 10/48 177/245
6,799,804 B1 * 10/2004 Fournier ..... A47C 16/02 297/217.3
7,117,611 B2 * 10/2006 Park ..... A47K 10/48 34/90
7,184,655 B2 * 2/2007 Dehli ..... A47C 7/748 34/90
7,288,110 B1 * 10/2007 Levine ..... A61F 7/007 607/104
7,509,755 B2 * 3/2009 Avanzini ..... A47K 10/48 34/232
D599,452 S * 9/2009 Israel ..... D23/335
2002/0189125 A1 * 12/2002 Lancer ..... A47K 10/48 34/90
2007/0046107 A1 * 3/2007 Jayaram ..... F24H 9/2071 307/117
2008/0181589 A1 * 7/2008 Dean ..... F24H 3/0417 392/373
2009/0064411 A1 * 3/2009 Marquette ..... B60H 1/00742 5/423
2010/0290765 A1 * 11/2010 Lee ..... F24H 9/02 392/485
2013/0259456 A1 * 10/2013 Viswanathan ..... F24C 1/08 392/407
2015/0104159 A1 * 4/2015 Tyburk ..... F24F 7/007 392/361
2015/0241122 A1 * 8/2015 Cross ..... F24H 3/0411 34/218
2016/0218884 A1 * 7/2016 Ebrom ..... H05B 1/0252
2018/0172266 A1 * 6/2018 Folk ..... F21L 13/00
2019/0170397 A1 * 6/2019 Saubert ..... F24H 3/0417

* cited by examiner

PERSONAL HEATER

RELATED APPLICATIONS/INCORPORATION BY REFERENCE

The present application claims benefit from and priority to U.S. Application No. 62/594,472, filed Dec. 4, 2017. The above-identified application is hereby incorporated herein by reference in its entirety.

FIELD OF THE DISCLOSURE

Certain embodiments of the disclosure relate to systems and methods for providing a heating device and, in particular, a heating device that provides targeted heating.

BACKGROUND OF THE DISCLOSURE

A conventional heater warms the entire room. This is a highly inefficient use of resources and time, especially when a person has just come out of the cold and is experiencing, for example, cold feet or cold lower legs.

Further limitations and disadvantages of conventional and traditional approaches will become apparent to one of skill in the art, through comparison of such systems with the present disclosure as set forth in the remainder of the present application with reference to the drawings.

BRIEF SUMMARY OF THE DISCLOSURE

Systems, devices, and methods for providing a heating device are provided substantially as illustrated by and/or described in connection with at least one of the figures, as set forth more completely in the claims.

Various advantages, aspects and novel features of the present disclosure, as well as details of an illustrated embodiment thereof, will be more fully understood from the following description and drawings.

DETAILED DESCRIPTION OF THE DISCLOSURE

As utilized herein the terms "circuit" and "circuitry" refer to physical electronic components (i.e., hardware) and any software and/or firmware ("code") which may configure the hardware, be executed by the hardware, and/or otherwise be associated with the hardware. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g." and "for example" set off lists of one or more non-limiting examples, instances, or illustrations.

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated.

Some embodiments of the present disclosure relate to systems, methods, and devices for providing a heating system.

Some embodiments of the present disclosure provide a heater with a housing design that enables the user to place one or both of the user's feet in the flow of heated air in a cavity of the housing. Some embodiments of the present disclosure provide that, if the heater is to be used as a general heater, the heater directs heat flow to an area outside of the housing. In some embodiments of the present disclosure, the heater reverses heat flow from acting on the interior of the housing (e.g., a cavity of the housing) to acting on the outside of the housing (e.g., above the housing). Some embodiments of the present disclosure provide that the heater can heat both inside the housing (e.g., a cavity of the housing) and outside of the housing.

Some embodiments of the present disclosure provide a heater (e.g., a personal heater) with a housing design that focuses warm air directly to the user's feet (e.g., bare feet, socks, shoes, slippers, sandals, open-toed shoes, etc.). In some embodiments, the heater can be switched from directly warming the user's feet to emitting warm air from the top of the heater to heat the surrounding area (e.g., the user's lower legs, the space under a desk, the space around a chair, etc.). Some embodiments of the present disclosure provide that the heater can switched to warm both (e.g., concurrently or alternately) the space inside the heater (e.g., where the user's feet are disposed) and the surrounding space around the heater. This targeted heating solves the problem of having cold feet and/or cold lower legs or body.

Figure 1:
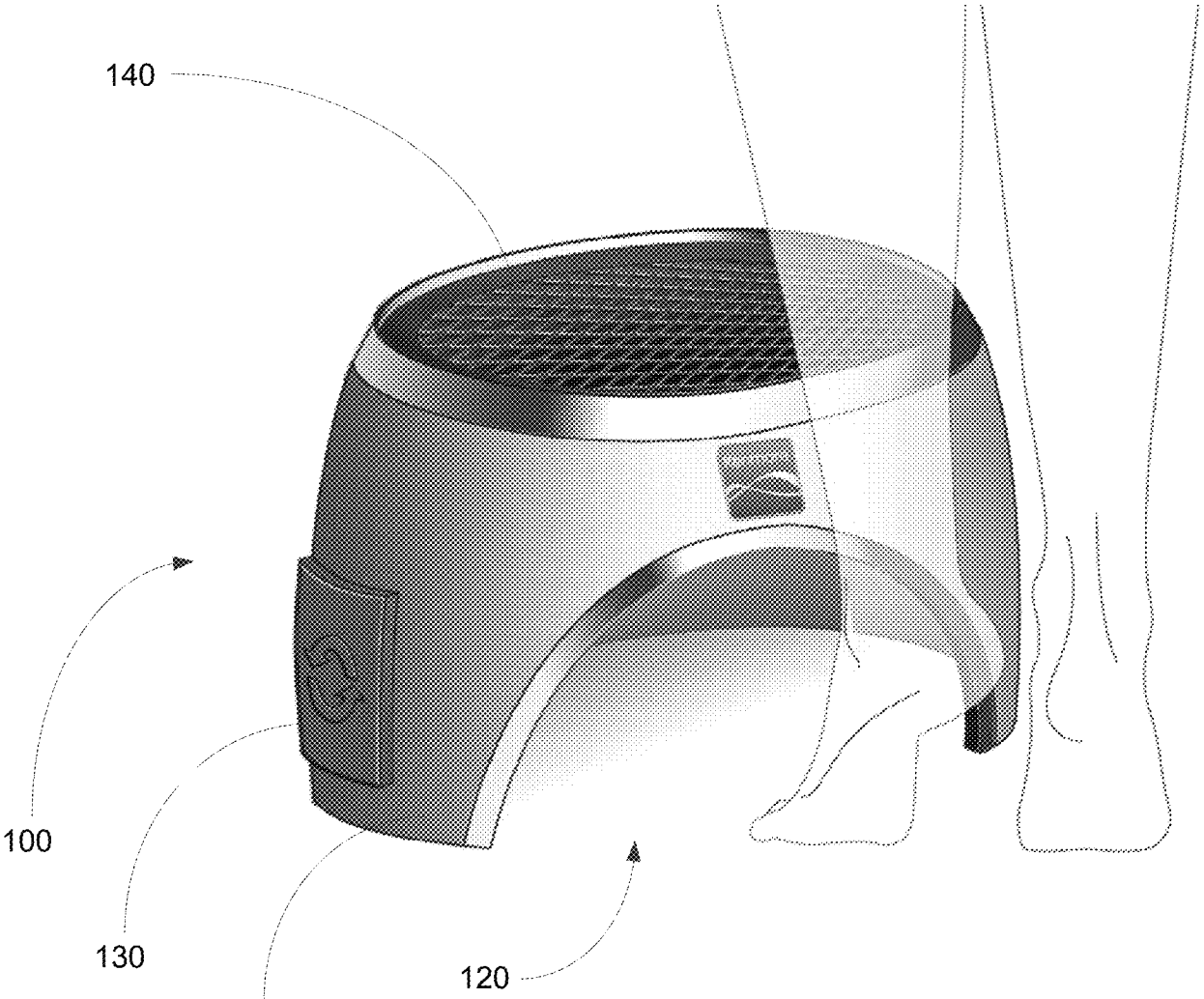
FIG. 1 shows an embodiment of the personal heater according to the present disclosure.

FIG. 1 shows an embodiment of a personal heater 100 according to the present disclosure. Referring to FIG. 1, the personal heater 100 can include, for example, a housing 110 (e.g., a plastic housing), a foot warming opening 120, an airflow redirect button 130, and a grate 140 (e.g., a metal grate). The personal heater 100 can be placed, for example, under a desk so that the user can employ the personal heater 100 while sitting or standing.

Figure 3:
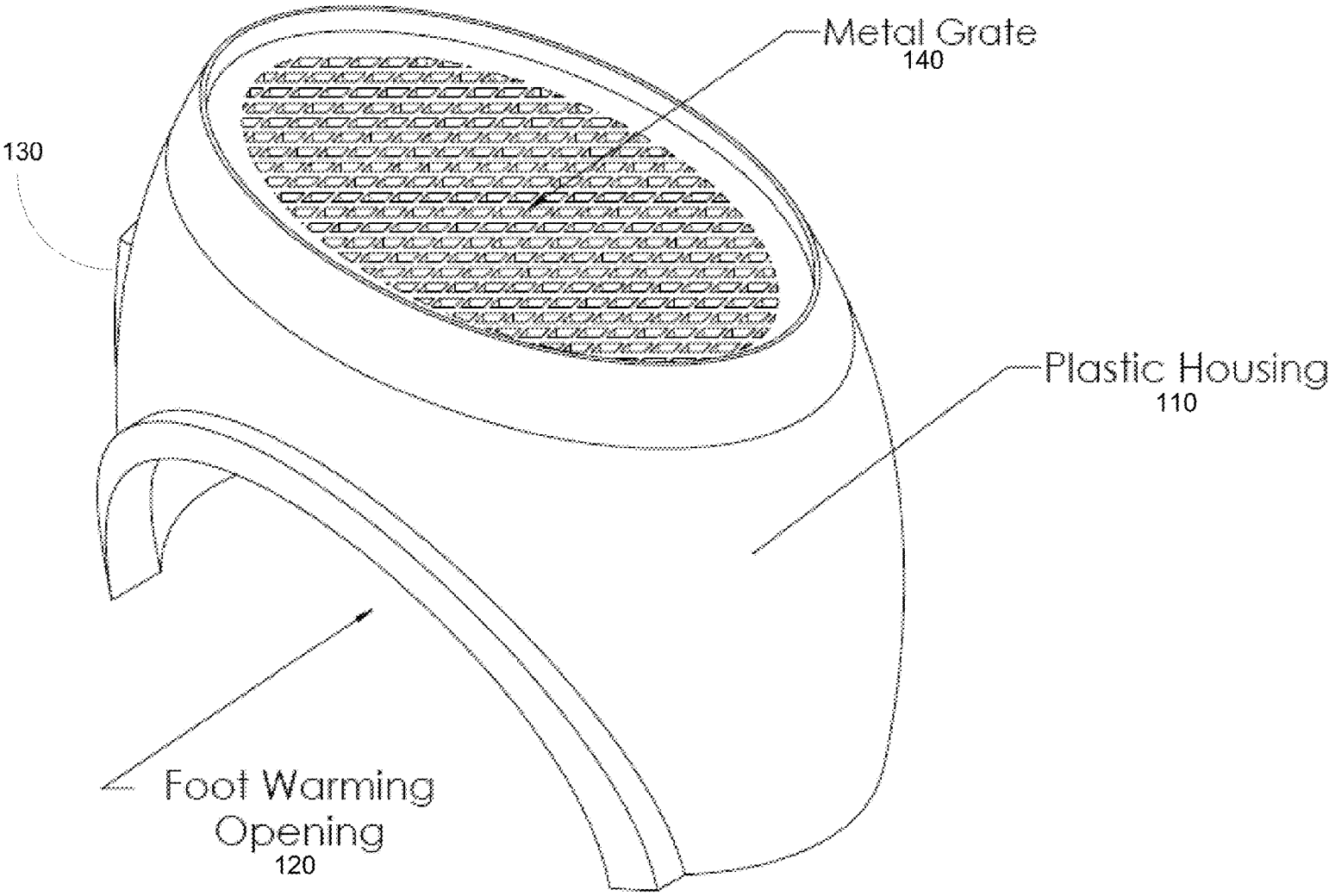
FIG. 3 shows a perspective view of an embodiment of the personal heater according to the present disclosure.
Figure 4:
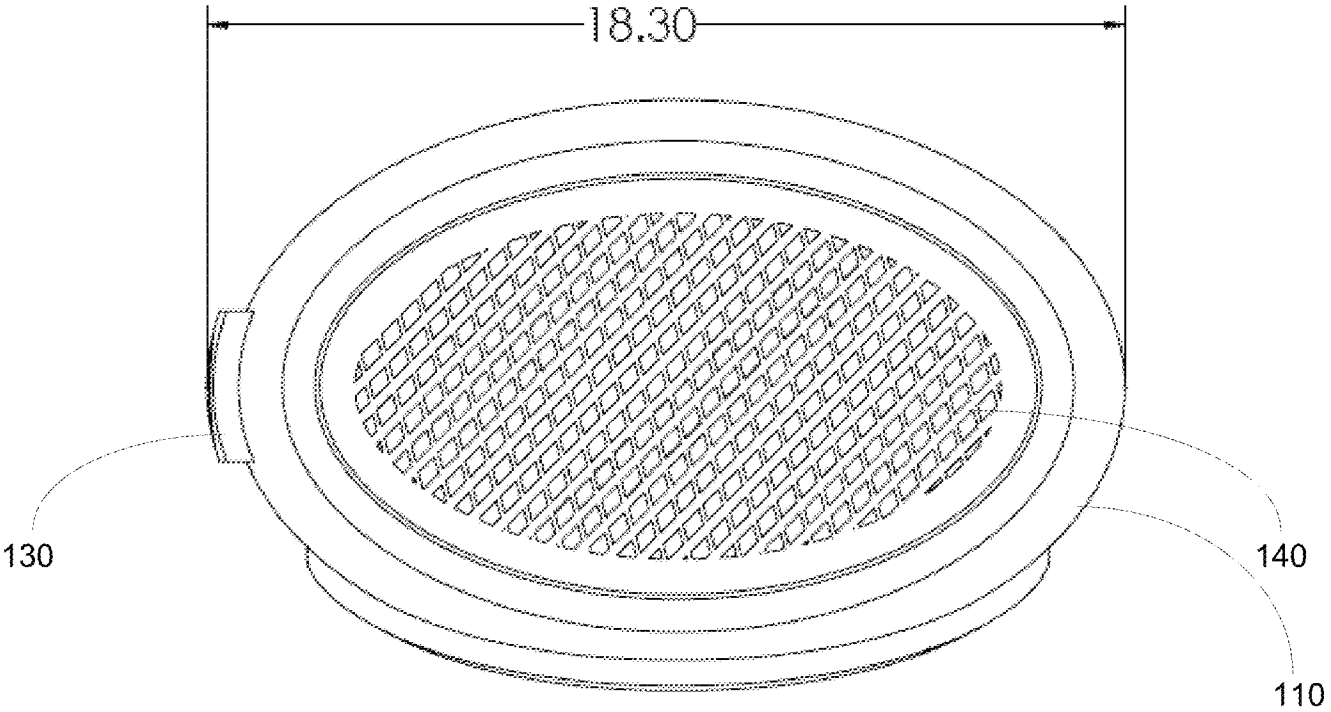
FIG. 4 shows a top view of an embodiment of the personal heater according to the present disclosure.
Figure 5:
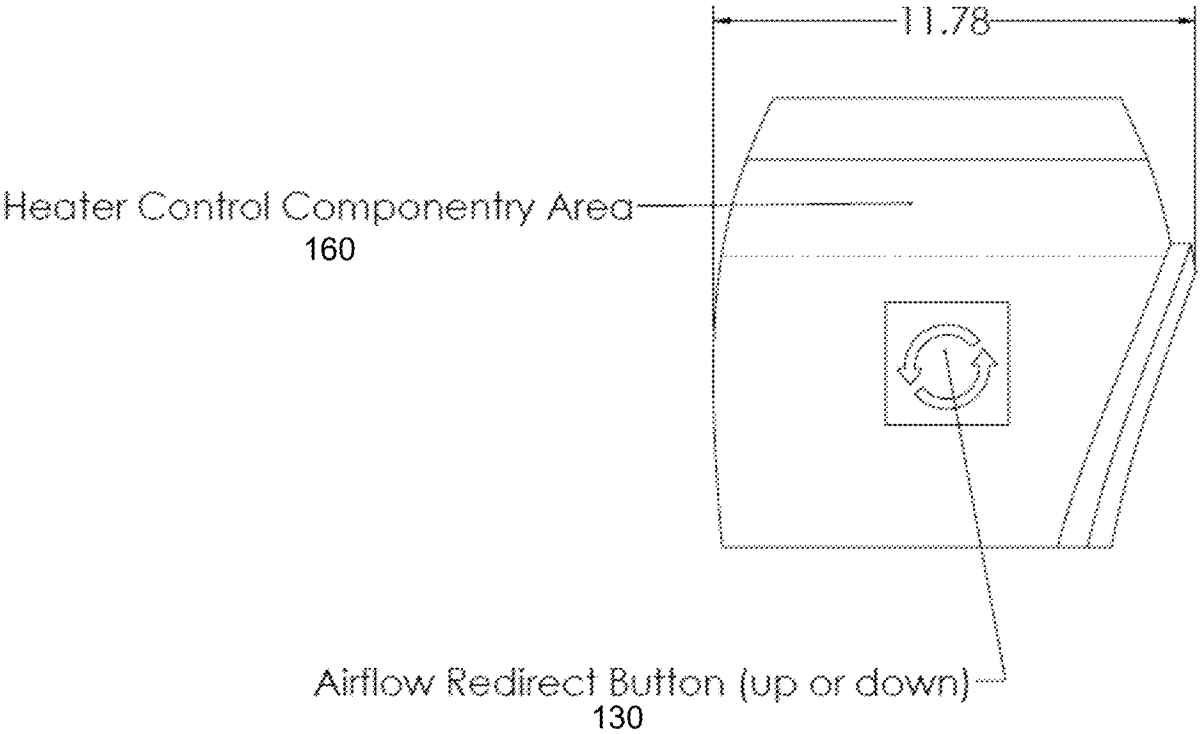
FIG. 5 shows a side view of an embodiment of the personal heater according to the present disclosure.
Figure 6:
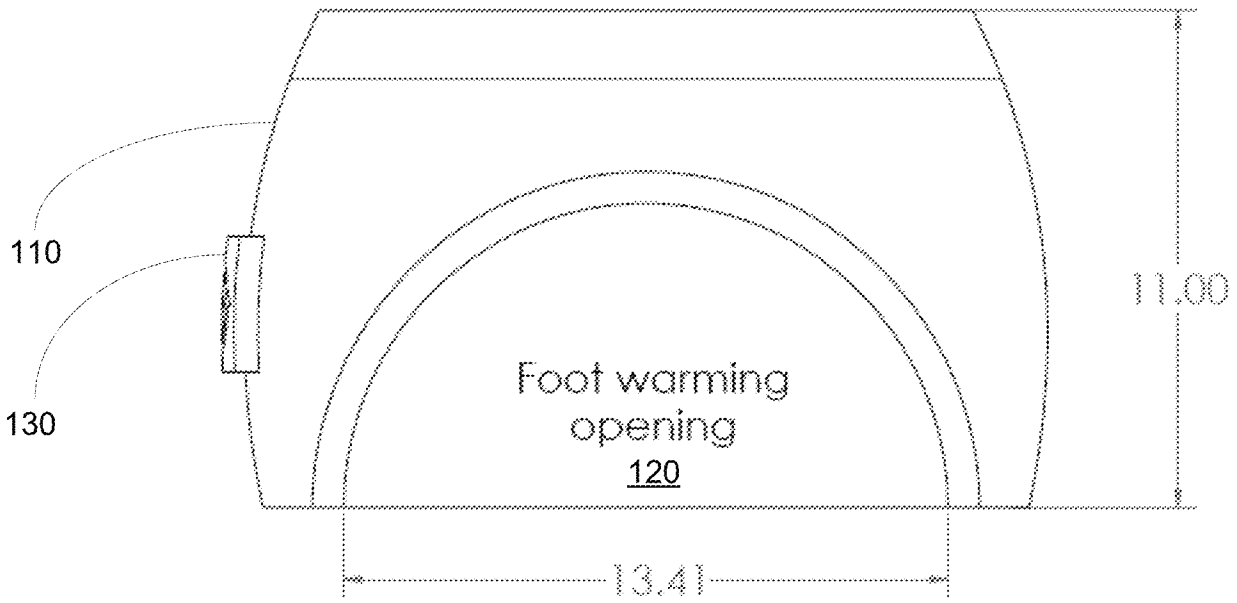
FIG. 6 shows another side view of an embodiment of the personal heater according to the present disclosure.

FIGS. 3-7 show embodiments of components of the personal heater 100 according to the present disclosure. FIG. 3 shows a perspective view of the personal heater 100 which includes, for example, a plastic housing 110, a foot warming opening 120, an airflow redirect button 130, and the metal grate 140. FIG. 4 shows a top view of the personal heater 100 which includes, for example, the plastic housing 110, the button 130, and the metal grate 140. The exemplary personal heater 100 is approximately 18.30 inches across according to one embodiment, although other distances are also contemplated and within the scope of the present disclosure. Further, although the metal grate 140 is shown as disc shaped, other shapes are contemplated and within the scope of the present disclosure. FIG. 5 shows a side view of the personal heater 100 which includes, for example, the airflow redirect button 130 and the heater control component area 160. The airflow redirect button 130 can be configured to cause the heat, for example, to flow up through the metal grate 140 or flow down into the cavity created underneath the plastic housing 110, for example. The exemplary personal heater 100 is approximately 11.78 inches across according to one embodiment, although other distances are also contemplated and within the scope of the present disclosure. FIG. 6 shows a side view of the personal heater 100 which includes, for example, the airflow redirect button 130, the plastic housing 110, and the foot warming opening 120. The exemplary foot warming opening 120 is approximately 13.41 inches across according to one embodiment, although other distances are also contemplated and within the scope of the present disclosure. Further, although the foot warming opening 120 is shown as semi-circular, other shapes are contemplated and within the scope of the present disclosure. The exemplary personal heater 100 is approximately 11.00 inches in height according to one embodiment, although other distances are also contemplated and within the scope of the present disclosure.

In operation, the user places one or more feet through the foot warming opening 120 and into a cavity underneath the plastic housing 110. Some embodiments provide that a motion sensor can be used to detect whether feet have been placed through the foot warming opening 120 or are inside the housing 110 (e.g., the cavity of the housing 110). Upon detection or by accessing a user interface (e.g., a button on the exterior of the housing or a graphical user interface on an application running on a wireless communication device), the heating element in the heater control component area 160 under the grate 140 provides heat that a fan (not shown) directs downward toward the one or more feet in the housing 110. The heat can be cycled such that a desired temperature or warmth can be reached. In some embodiments, the shape and material properties of the housing 110 are such that heat is advantageously stored in the housing 110 (e.g., a cavity formed by the housing 110), thereby providing the user's feet with a warm enclosed space. In some embodiments, the housing 110 is shaped to surround the user's feet including beneath the user's feet. The portion beneath the user's feet can also include, for example, a heating plate that is activated when the user's feet are placed on top of the bottom portion of the housing 110 and/or placed in the cavity of the housing 110. The airflow redirect button 130 can be pressed to change the flow of the heat according to some embodiments. For example, when the button 130 is pressed, the fan reverses and the heat flows upward through the grate 140. In this case, the heat can be used to heat the user's lower half or body (e.g., legs, lower legs, etc.). In some embodiments, sensors can sense when the feet are removed from the interior of the housing 110, and, in response, the fan can reverse such that the heat flows upward and outside the housing 110, or the personal heater 100 can be turned off.

Although some embodiments contemplate using fan reversals to change the direction of heat flow, the heating elements can be structured to direct radiative heat or other types of heat transfer in a particular direction by using heat reflecting disks or panels. Thus, for example, a first heating element can be set up to send heat upwards, while a second heating element can be set up to send heat downwards. There can be, for example, a heat reflecting panel between the heating elements. Thus, the button 130 can cause one heating element and/or the other to turn on, thereby heating feet within the housing 110 and/or legs outside the housing 110. Some embodiments contemplate turning on both heating elements on occasions in which the user wants to heat both feet inside the housing 110 and lower legs outside the housing 110 at the same time.

Figure 2:
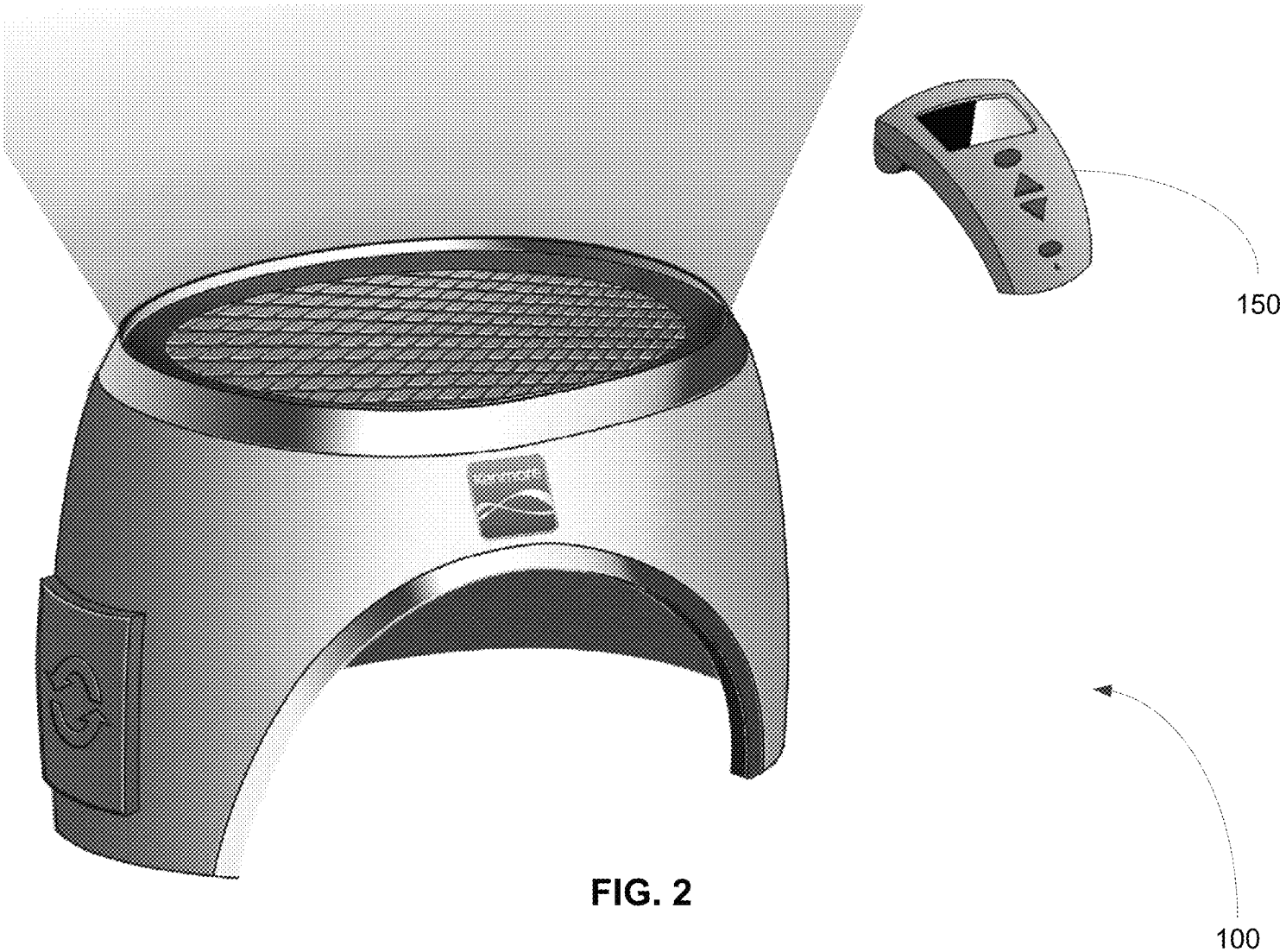
FIG. 2 shows an embodiment of a remote controlled personal heater according to the present disclosure.

FIG. 2 shows a remote controlled personal heater 100 according to the present disclosure. The remote control 150 can be a wireless device (e.g., a wireless communication device, a mobile wireless communication device, a cellular phone, a smart phone, a wireless computing tablet, a wireless computer, a fob, etc.) and can include, for example, an application running on the wireless device. The remote control 150 can turn on or off the personal heater 100. Further, the remote control 150 can control the temperature, intensity and/or amplitude of the heat being emitted by the persona heater 100 as well as the direction (e.g., upwards and/or downwards) of the heat flow. The remote control 150 can communicate with the personal heater 100 directly (e.g., Bluetooth communications, infrared communications, WiFi communications, wired link), or indirectly via a network (e.g., wireless local area network, cloud network, cellular network, WiFi communications, an access point, a base station, etc.). Furthermore, the remote control 150 can program the personal heater 100 for particular heating cycles and/or parameters. In one embodiment, the remote control 150 can program the personal heater 100 to turn on or off at a particular time and/or a particular time duration.

Some embodiments contemplate that the user can use a smart phone or some other wireless device 150 to activate the personal heater 100 before the user arrives. For example, a user in a parking lot can use a smart phone 150 to turn on the personal heater 100 before the user arrives at the user's desk. Thus, the personal heater 100 is already warmed up and waiting for the user. Some embodiments also contemplate that the personal heater 100 have sensors that cause the personal heater 100 to reduce heat flow or turn off completely if the temperature is too high or if other unsafe conditions exist.

Some embodiments contemplate that the personal heater 100 can be used for one foot and that another personal heater 100 can be used for another foot. The two personal heaters 100 can be controlled individually or together.

Some embodiments contemplate that the personal heater 100 includes a rechargeable battery so that the personal heater 100 can be portable and taken with the user. For example, the personal heater 100 can be placed on a bleacher or on the ground to warm up the user's feet during a sports event. The user can be standing or sitting when using the personal heater 100.

Figure 7:
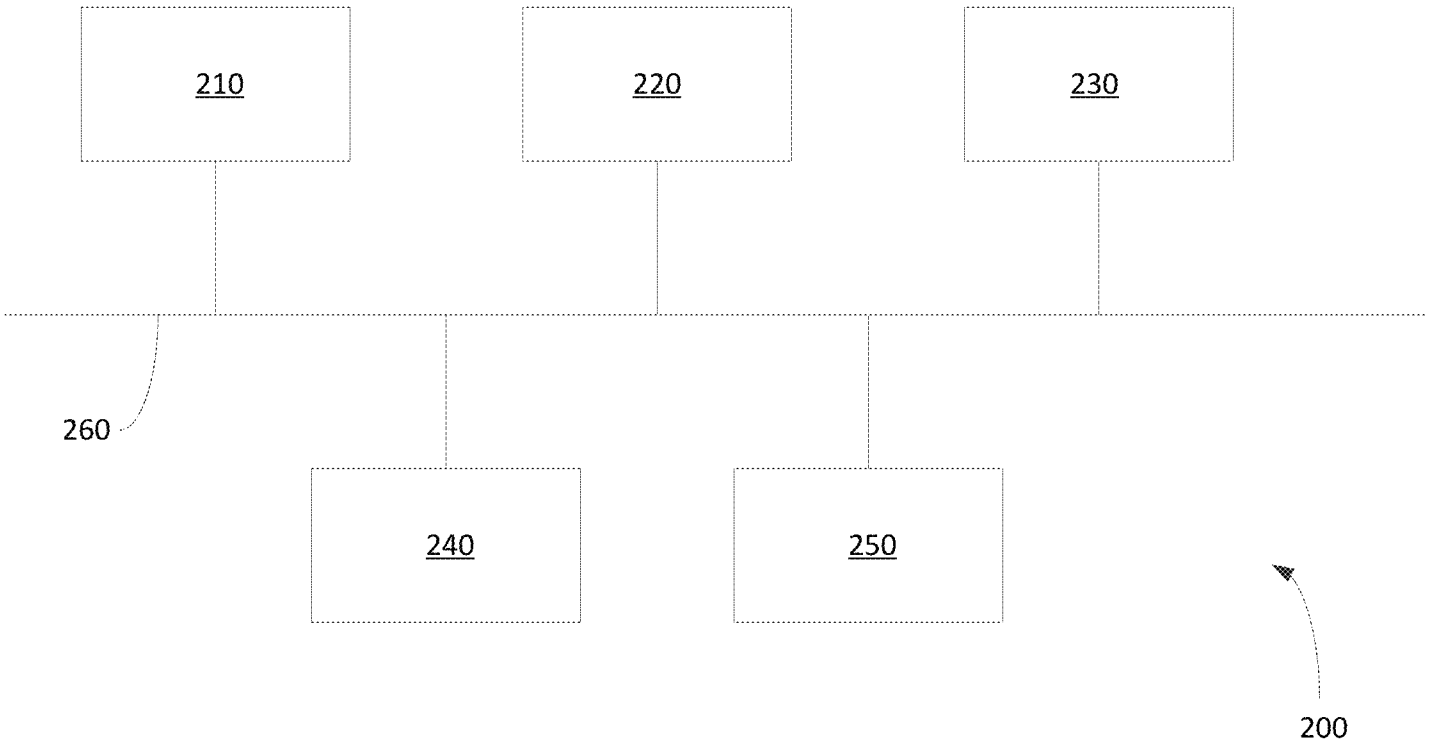
FIG. 7 shows an embodiment of one or more circuits of the personal heater according to the present disclosure.

FIG. 7 shows an embodiment of one or more circuits 200 (e.g., component arrangement, device arrangement, and/or circuit arrangement) of the personal heater 100 according to the present disclosure. The one or more circuits 200 illustrated in FIG. 7 are not comprehensive and can be supplemented with other components, devices, and/or circuits. Furthermore, not every component illustrated in FIG. 7 need be present. The one or more circuits 200 can be used to perform any, some, or all of the functions and/or features describe herein. For example, the one or more circuits 200 can be used to receive wireless signals from a smart phone 150 and to cause the personal heater 100 to turn on one or more of its heating elements in accordance with a stored program and/or stored parameters. In another example, the one or more circuits 200 can include motion sensors that can detect when a foot is placed inside the housing 110 and then cause the heater that heats the interior of the housing 110 to turn on.

In some embodiments, the one or more circuits 200 can include, for example, one or more processors 210, one or more memories 220 (e.g., one or more nontransitory memories), one or more communication devices 230 (e.g., wireless adapters, wireless cards, cable adapters, wire adapters, dongles, radio frequency (RF) devices, wireless communication devices, Bluetooth devices, IEEE 802.11-compliant devices, WiFi devices, cellular devices, GPS devices, Ethernet ports, network ports, Lightning cable ports, cable ports, etc.), one or more input devices 240 (e.g., keyboards, mouse, touch pad, touch-sensitive screen, touch screen, pressure-sensitive screen, graphical user interface, user interfaces, buttons, microphone, etc.), and one or more output devices 250 (e.g., displays, screens, speakers, projectors, etc.). The processor 210, the memory 220, the communication device 230, the input device 240, and/or the output device 250 can be connected to one or more buses 260 or other types of communication links (e.g., wired and/or wireless links).

The processor 210 can include, for example, one or more of the following: a general processor, a central processing unit, a digital filter, a microprocessor, a digital processor, a digital signal processor, a microcontroller, a programmable array logic device, a complex programmable logic device, a field-programmable gate array, an application specific integrated circuit, one or more cloud or network servers operating in series or in parallel, and a memory. Code, instructions (e.g., processor-executable instructions), software, firmware and/or data may be stored in the processor 210, the memory 220, or both and can be used to perform any, some, or all of the functions and/or features describe herein.

The memory 220 can include, for example, one or more of the following: a non-transitory memory, a non-transitory processor readable medium, a non-transitory computer readable medium, read only memory (ROM), random access memory (RAM), non-volatile memory, dynamic RAM (DRAM), volatile memory, erasable programmable ROM (EPROM), electrically EPROM (EEPROM), ferroelectric RAM (FRAM), first-in-first-out (FIFO) memory, last-in-first-out (LIFO) memory, stack memory, non-volatile RAM (NVRAM), static RAM (SRAM), a cache, a buffer, a semiconductor memory, a magnetic memory, an optical memory, a flash memory, a flash card, a compact flash card, memory cards, secure digital memory cards, a microcard, a minicard, an expansion card, a smart card, a memory stick, a multimedia card, a picture card, flash storage, a subscriber identity module (SIM) card, a hard drive (HDD), a solid state drive (SSD), etc. The memory 220 can be configured to store code, instructions, applications, software, firmware and/or data for use by the processor 210 and may be external, internal, or both with respect to the processor 210.

In some embodiments, some of the code, instructions, applications, software, firmware and/or data can be hardwired (e.g., hardware implementations, hardwired into registers, etc.) and/or can be programmable.

In some embodiments, some or all of the steps, acts, methods, and/or processes described herein can be performed by code, software, firmware, and/or instructions, for example, that are executed by the processor 210 and stored in the memory 220 of personal heater 100.

In some embodiments, the one or more circuits 200 can be found in a user device (e.g., a remote control, a smartphone, a laptop, a tablet, etc.) that can be used to control, input data into, receive data from, and/or communicate with the personal heater 100. In some embodiments, some or all of the steps, acts, methods, and/or processes described herein can be performed by code, software, firmware, and/or instructions, for example, that are executed by the processor 210 and stored in the memory 220 of the user device and/or the personal heater 100.

Other embodiments of the present disclosure may provide a non-transitory computer readable medium and/or storage medium, and/or a non-transitory machine readable medium and/or storage medium, having stored thereon, a machine code and/or a computer program having at least one code section executable by a machine and/or a computer, thereby causing the machine and/or computer to perform the steps as described herein.

Accordingly, aspects of the present disclosure may be realized in hardware, software, or a combination of hardware and software. The present disclosure may be realized in a centralized fashion in at least one computer system or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

Aspects of the present disclosure may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A heater, comprising:

a housing comprising an opening for receiving one or more feet;

a heating element; and a controller that causes the heating element to heat both of an interior of the housing and an exterior of the housing until the housing receives the one or more feet, wherein the exterior of the housing is not heated when the one or more feet are inside the housing.

2. The heater according to claim 1, comprising:

a sensor that detects when one or more feet are inside the housing.

3. The heater according to claim 2, wherein the controller causes the heating element to heat the interior of the housing when the sensor detects that one or more feet are inside the housing.

4. The heater according to claim 1, comprising:

a sensor that detects motion within the housing.

5. The heater according to claim 4, wherein the controller causes the heating element to heat the interior of the housing when the sensor detects motion within the housing.

6. The heater according to claim 1, comprising:

a wireless receiver that is configured to receive wireless signals that the controller uses to control the heating element.

7. The heater according to claim 2, wherein the sensor is configured to detect when the one or more feet are removed from inside of the housing, and the controller causes the heating element to heat the exterior of the housing when the sensor detects that the one or more feet are removed from the inside of the housing.

8. The heater according to claim 1, comprising:

a physical button on the housing, wherein the flow of heat is reversed when the button is pressed.

9. The heater according to claim 8, wherein the direction of heat is reversed when the button is pressed.

10. A heating system, comprising:

a personal heater that is configured to receive wireless communications from a wireless communication device, wherein the personal heater comprises a heating element, one or more processors, and a housing with an opening for receiving one or more feet, and wherein the one or more processors are configured to determine whether the one or more feet are inside the housing and to cause the heating element to heat an interior and an exterior of the housing until the one or more feet are inside the housing, wherein the exterior of the housing is not heated when the one or more feet are inside the housing.

11. The heating system according to claim 10, comprising:

a sensor that is operatively coupled to the one or more processors, wherein the sensor is configured to detect when one or more feet are inside the housing.

12. The heater system according to claim 11, wherein the one or more processors cause the heating element to heat the interior of the housing when the sensor detects that one or more feet are inside the housing.

13. The heating system according to claim 10, comprising:

a sensor operatively coupled to the one or more processors, wherein the sensor is configured to detect motion within the housing.

14. The heater system according to claim 13, wherein the one or more processors cause the heating element to heat the interior of the housing when the sensor detects motion within the housing.

15. The heater system according to claim 10, wherein the personal heater receives wireless signals directly from the wireless communication device, and the one or more processors process the wireless signals to control the personal heater.

16. The heater system according to claim 10, wherein the personal heater receives wireless signals from the wireless communication device via a wireless network, and the one or more processors process the wireless signals to control the personal heater.

* * * * *